US007090435B2

(12) United States Patent
Mitchell

(10) Patent No.: US 7,090,435 B2
(45) Date of Patent: Aug. 15, 2006

(54) METHOD AND APPARATUS FOR RAISING, LEVELING, AND SUPPORTING DISPLACED FOUNDATION ALLOWING FOR READJUSTMENT AFTER INSTALLATION

(76) Inventor: Leroy Mitchell, 230 Duke #2, San Antonio, TX (US) 78264

( * ) Notice: Subject to any disclaimer, the term of this patent is extended or adjusted under 35 U.S.C. 154(b) by 0 days.

(21) Appl. No.: 10/949,161

(22) Filed: Sep. 24, 2004

(65) Prior Publication Data

US 2006/0067794 A1 Mar. 30, 2006

(51) Int. Cl.
*E02D 5/52* (2006.01)
*E02D 5/54* (2006.01)

(52) U.S. Cl. ..... 405/230; 405/249; 405/251; 405/253

(58) Field of Classification Search ..... 405/229, 405/230, 231, 244, 249, 250, 251, 253
See application file for complete search history.

(56) References Cited

U.S. PATENT DOCUMENTS

| | | | | |
|---|---|---|---|---|
| 3,796,055 | A | 3/1974 | Mahony | |
| 3,902,326 | A | 9/1975 | Langenbach | |
| 4,195,487 | A | 4/1980 | Fukushima | |
| 4,925,345 | A | 5/1990 | McCown, Jr. et al. | |
| 5,154,539 | A | 10/1992 | McCown, Sr. et al. | |
| 5,205,673 | A * | 4/1993 | Bolin et al. | 405/230 |
| 5,288,175 | A | 2/1994 | Knight | |
| 5,505,561 | A | 4/1996 | Willcox, II | |
| 5,531,544 | A | 7/1996 | Willcox, II | |
| 6,074,133 | A | 6/2000 | Kelsey | |
| 6,539,685 | B1 | 4/2003 | Bell et al. | |
| 6,684,577 | B1 | 2/2004 | Dimitrijevic | |
| 2004/0141814 | A1 * | 7/2004 | Covington | 405/230 |

* cited by examiner

*Primary Examiner*—Thomas B. Will
*Assistant Examiner*—Tara L. Mayo
(74) *Attorney, Agent, or Firm*—Charles W. Hanor; Charles W. Hanor, P.C.

(57) ABSTRACT

A method and apparatus for raising, leveling, and supporting a foundation by placing steel piers beneath the necessary peripheral and interior beams and using a jack to raise the slab beams, then allowing the slab beams to rest on piers. The piers are constructed from steel piling segments, driven into the ground, connected with adhesive, and anchored at a depth offering reactive force sufficient to support the foundation. The piling is pointed at its bottom facilitating insertion and preventing upheaval. A crown is attached to the upper most end of each pier which offers a platform to provide a stable support once the jack is removed and easy access to the slab beam for later readjustment. Multiple piers are utilized to achieve a level foundation. Piers may be placed beneath interior beams on a slab without drilling holes in the interior of the slab.

26 Claims, 5 Drawing Sheets

METHOD AND APPARATUS FOR RAISING, LEVELING, AND SUPPORTING DISPLACED FOUNDATION ALLOWING FOR READJUSTMENT AFTER INSTALLATION

CROSS-REFERENCE TO RELATED APPLICATIONS

STATEMENTS REGARDING FEDERALLY SPONSORED RESEARCH OR DEVELOPMENT

REFERENCE TO A MICROFICHE APPENDIX

BACKGROUND OF THE INVENTION

1. Field of the Invention

This invention relates to the field of raising, leveling, and supporting existing structures that have become uneven. More particularly, the present invention is a method for raising, leveling, and supporting an existing structural foundation through the use of one or more steel piers which have been driven to a depth adequate to support the structure to be raised.

2. Description of the Related Art

Normal movement, settlement, expansion and contraction of supporting soil may cause a building's structure and its foundation to move, thereby damaging the foundation. Furthermore, excess moisture, such as plumbing leaks, over watered lawns, rainfall and the like, causes uneven movement such as flexing and/or swelling of the foundation resulting in structural and cosmetic damage to the building. The damage may be seen in items such as distorted or broken window frames and panes, sloped flooring, wrinkles in wallpaper and cracked doors, walls, driveways and the like.

Several methods and systems for raising, leveling, supporting and repairing existing damaged foundations are known in the art. One basic method used to achieve an even and stable foundation is to implant pilings directly beneath a slab. In the case of a larger slab it is often necessary for holes to be bored through a building structure's flooring to allow access to the interior beams of the foundation. To support a peripheral or interior beam, the access hole is dug into the earth to a depth typically equal to the length of a support piling and the piling is driven into the ground, one on top of the other, until a certain depth is reached. The building is raised, typically using a hydraulic pump, up to a desired height. By implanting pilings or piers directly beneath the foundation beams, the piers or pilings anchor the foundation by directly supporting the weight of the structure. However, problems have often been encountered with trying to balance the weight of the foundation on the piles or piers.

Many inventions have been dedicated to solving this balancing problem such as the invention described in U.S. Pat. No. 5,288,175 (hereinafter called "the '175 patent") issued to Knight on Feb. 22, 1994. The '175 patent uses a reinforced segmental precast concrete pile to support the foundation of a structure. Each segment is aligned during installation and continuously reinforces the pile when anchored upon completion.

Another invention focused on providing balance and stability to a building's foundation is shown in U.S. Pat. No. 4,195,487 (hereinafter called "the '487 patent") issued to Fukushima on Apr. 1, 1980. The '487 patent describes a method of preventing upward movement of foundation pillars in weak ground, where concrete piles are required as the foundation pillars. The concrete piles used in the '175 and '487 patents have given few benefits to re-leveling pre-existing structures and offered many disadvantages.

First, cement piles require very large diameters to reach load-bearing strengths, but driving these pilings into the ground also requires a very large force. Second, cement piles have a greater potential for fracture as they encounter obstructions such as rocks and tree roots on their way into the ground. Third, cement piers take a greater amount of time to utilize especially if a hole is dug first and the piling is constructed in situ.

Further, many inventions using cement piers were not adjustable, though some prior art has utilized complex adjustable anchors. An example of an adjustable pier is seen in U.S. Pat. No. 6,074,133 (hereinafter called "the '133 patent) issued to Kelsey on Jun. 13, 2000. The '133 patent provides for an adjustable foundation piering system in which piers are used to support a building foundation. The adjustable pier is partially encapsulated in the foundation when the foundation is poured. Upon settling of the foundation, the adjustable pier can then be raised. Unfortunately, the '133 piering system is only used to raise and level a foundation as the foundation is being poured which has no benefit to foundations with existing damage.

Inventions utilizing steel piers or pilings were designed to eliminate the difficulties that stemmed from using cement pile or pier structures. U.S. Pat. No. 3,902,326 (hereinafter called "the '326 patent") issued to Langenbach on Sep. 2, 1975 described a frictionless steel pier system used to stabilize the foundations of settling structures. The steel piers are driven to bedrock or equal load bearing strata and are secured to the foundation to provide unvarying support. However, this frictionless steel pier system heavily depends upon reaching a stable bedrock, which may in some cases be nonexistent. Over time, the frictionless pier system has decreased stability and overall-load bearing capability which allows for denting, bending and potential corrosion of the steel piers.

U.S. Pat. No. 6,684,577 (hereinafter called "the '577 patent") issued to Dimitrijevic on Feb. 3, 2004 transitioned from the frictionless steel piering system to a support system using H-beams and I-beams being positioned underneath an existing building. A vertically-adjustable cap is then placed in contact with the beams; and a jack is disposed on a lower surface of the cap. The cap is then jacked up until the top end of the jack has pressed an upper surface of the cap against the lower surface of the building foundation. However, the use of such beams as the H-beams has decreased bearing characteristics due to the area of the end of the beam that is driven into the ground is less than that typically used for cement and steel pipe pilings.

The second basic method used to stabilize and support a foundation is to implant a piling or pier adjacent to a slab. An example of this adjacent method is seen in U.S. Pat. No. 6,539,685 (hereinafter called "the '685 patent") issued to Bell et al on Apr. 1, 2003. The '685 patent provides for an apparatus used to lift and stabilize a foundation including a lifting plate with a pipe section passed over an anchor pier. The anchor pier, located adjacent to the foundation, is secured to the lifting plate using mechanical fasteners. A jack then raises the lifting plate to a position where the foundation is leveled.

Another example of the adjacent method is shown in U.S. Pat. No. 5,154,539 (hereinafter called "the '539 patent") issued to McCown, Sr. et al. on Oct. 13, 1992. The '539 patent describes the usage of a support bracket extending longitudinally under the foundation, a yoke assembly disposed above the support bracket and a lifting cradle engageable to the bottom surface of the support bracket. A pile driving means is attached to the yoke assembly and is engageable upon a piling to be driven into the ground adjacent to the structure. However, these abovementioned prior art patents having a pier or pile adjacently located to the foundation have historically had problems with stability due to the method of transferring the load of the structure to the piling or pier.

In view of the above described deficiencies associated with the use of conventional methods and systems for raising, leveling, supporting and repairing existing damaged foundations, the present invention has been developed to alleviate these drawbacks and provide further benefits to a user. These enhancements and benefits are described in greater detail herein below with respect to several embodiments of the present invention.

BRIEF SUMMARY OF THE INVENTION

The present invention in its several disclosed embodiments alleviates the drawbacks described above with respect to methods and systems for raising, leveling, supporting and repairing existing damaged foundations and incorporates several additional beneficial features. The present invention described herein is an apparatus and method for raising, leveling, and supporting an uneven structural foundation by placing piers at necessary points directly beneath the foundation and driven to a depth that allows the structure's foundation to be raised with a jack. The piers are constructed preferably from piling segments which are driven into the ground, connected with adhesive, and anchored at a depth which offers a reactive force suitable to support the slab beam above. Each pier is pointed at its bottom end and deepest point in order to facilitate insertion and prevent upheaval. A crown is attached to the piers, which offers a platform to place a jack and raise the slab to a stable supportive position and provide for easy access to the slab beam for later readjustment. In a preferred embodiment, multiple piers may be utilized to achieve a level foundation. An advantage of the present invention is the piers are positioned beneath the structure's foundation thereby eliminating the need for a complex anchoring system which only tangentially addresses the inherent problem in the design. Second, the piers are made of inexpensive but strong hollow steel pipes, which provide decreased driving force, increased strength, increased durability, and decreased installation time when compared to cement piers. The present invention also introduces a pointed starter segment which further lowers the driving force and installation time by acting as a pierce when inserted into the earth to move obstacles which may dent the pier structure. After installation, the pointed started segment acts as an anchor preventing upheaval due to soil expansion, a problem encountered by all pier systems.

Initially, holes are dug in the earth directly beneath the foundation where leveling is sought. A piling starter segment is driven vertically into the ground beneath the slab beam using a driver such as a hydraulic ram. Additional piling segments are attached to the starter segment to form a pier and are driven deeper into the earth until the reactive force (pressure) reaches an adequate level to support the foundation. The pier is capped with the crown which comprises of a collar, a horizontal base member, a base member support inset and two vertical support members. A jack is positioned on the crown which acts as both a platform for the jack and a support structure on which the slab beam may rest. The jack is then used to lift the slab and shims are placed atop the support members of the crown until they contact the underside of the slab beam. Finally, the jack is removed and the hole is then covered.

An additional advantage of the present invention is the piers are coated to prevent corrosion. Specifically, the pilings are sealed together not only to increase the overall stability of the structure by resisting bending, but also to seal joints from moisture, another common problem of hollow piers. The starter segment is also internally sealed providing additional strength to the segment and preventing weakness from corrosion from moisture and the like.

The present invention also includes a pile cap or "crown" designed to increase stability. The crown increases the contact surface area between the pier and the slab beam by utilizing two support members upon which shims are placed. These support members are placed such that access to the beam is as easy on its first use as on any subsequent re-leveling procedures that may be required. Also, later adjustment is similarly easy because anyone with a jack may access the pier and readjust the level of the slab even if that person has no expertise on the installation method or the apparatus. Overall, this invention maintains the advantages of being placed beneath the foundation over being inserted in an adjacent manner, of using steel piers over cement piers, of using an adjustable pier over a non-adjustable pier, and in the aggregate offers a system that decreases installation time, increases stability, decreases corrosion, and offers easy access for readjustment.

Interior slab beams may also be supported and leveled without having to drill interior access holes in the concrete slab to access the beams interior to the periphery of the slab. To reach interior slab beams a hole or tunnel can be dug from the outside edge to the point under the foundation where the pier is to be placed and then follow the method of this invention to level the foundation. Because the piers are small and easy to handle they can be easily positioned at the beams interior to the periphery of the slab through the tunnel under the slab.

Further advantages of this invention over the prior art are increased stability, stronger design, quickness of installation, increased durability, increased resistance to corrosion, ease of adjustability after installation, and ease of use and access to those not familiar with the invention. Older methods and apparatuses either relied upon an adjacent driving system which invoked stability problems or relied upon cement pilings which invoked problems such as the necessity of higher driving force, the susceptibility to corrosion, and prolonged installation time. This invention offers the advantage of direct, stable, and durable support to re-level a displaced foundation such that it can later be easily readjusted.

The present invention will be more clearly understood from the following description of illustrative embodiments thereof, to be read by way of example and not of limitation in conjunction with the apparatus and the method described. The beneficial effects described above apply generally to the exemplary devices disclosed herein of the method and apparatus for raising, leveling, and supporting displaced foundation allowing for readjustment after installation. The specific structures through which these benefits are delivered will be described in detail herein below.

BRIEF DESCRIPTION OF THE SEVERAL VIEWS OF THE DRAWINGS

The invention will now be described in greater detail in the following way of example only and with references to the attached drawings, in which.

DETAILED DESCRIPTION OF THE INVENTION

As required, detailed embodiments of the present invention are disclosed herein; however, it is to be understood that the disclosed embodiments are merely exemplary of the invention that may be embodied in various and alternative forms. The figures are not necessarily to scale, some features may be exaggerated or minimized to show details of particular components. Therefore, specific structural and functional details disclosed herein are not to be interpreted as limiting, but merely as a basis for the claims and as a representative basis for teaching one skilled in the art to variously employ the present invention.

This invention offers a method and apparatus for raising, leveling, and supporting a foundation by placing steel piers at necessary points directly beneath the foundation beams of a slab and using a jack to level the slab beam, then allowing the leveled slab beams to rest on support from the pier. The pier is constructed from a starter segment means and steel interconnected piling segments which are driven into the ground and a crown means. The interconnected piling segments are joined to one another with an adhesive and anchored by a piling starter segment means at a depth which offers a reactive force suitable to support the slab beam positioned above. The crown means provides stable support after a driving device such as a hydraulic ram or jack means in used to drive the piling starter segment means and the interconnected piling segments into the ground. Further, after the crown is positioned between the top of the interconnected piling segment and the slab beam to act as a platform to place a lifting device such as a jack means and level the slab or for later readjustment. Multiple formed piers can be utilized to achieve a level foundation. Interior slab beams may also be supported and leveled without having to drill interior holes in the concrete slab to access the beams interior to the periphery of the slab. To reach interior slab beams a hole can be dug from an outside edge to a point under the foundation where the pier is to be placed and then follow the method of this invention to level the foundation. The structure of the piers allows the insertion and positioning of the piers at the locations on the interior beams of the slab.

Figure 1:
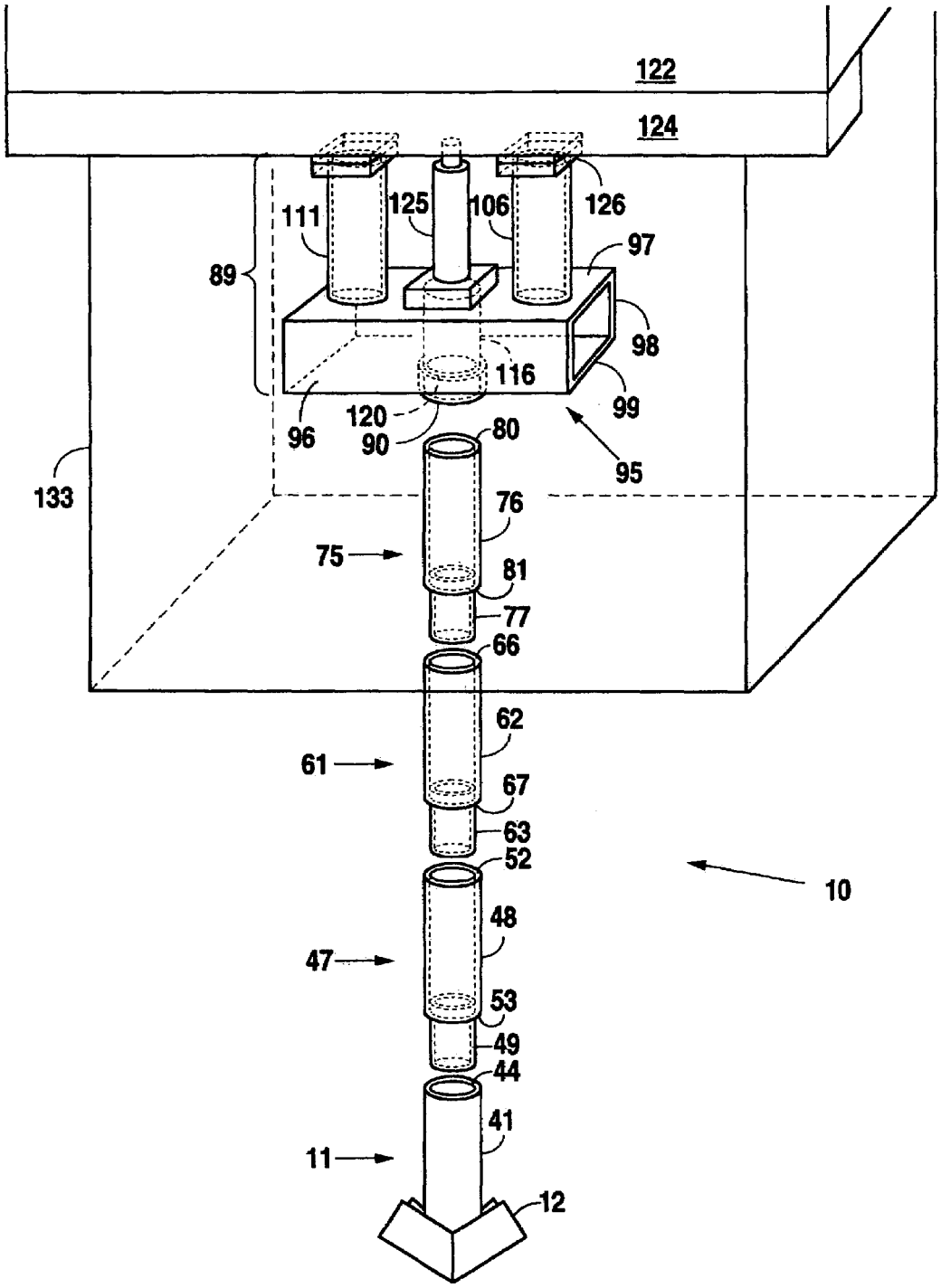
FIG. 1 is an exploded view of a pier.

As shown in FIG. 1, a formed pier 10 is constructed from interconnected piling segment means 47, 61, and 75, a piling starter segment means 11, and a crown means 89. The piling starter segment means 11 comprises of a starter segment member 41, preferably cylindrically shaped, having a top end 44 and a tip member 12 opposingly positioned from the top end 44. The piling starter segment means 11 is driven into the ground by a hydraulic ram or jack means and acts as a pierce to carve a hole in the earth, preferably about 3'×3'×3', thereby making room for the insertion of the piling segment means 47, 61 and 75. The piling segment means 47, 61, and 75 is made of steel since this material is able to handle compressive forces from a building's structure. The steel segments or piers are small but strong so that they can be easily placed and positioned under the slab. Each piling segment means 47, 61 and 75 has an upper end 52, 66 and 80 respectively and a bottom end 53, 67 and 81 respectively, and is preferably cylindrically shaped. Each bottom end 53, 67 and 81 of the piling segment means 47, 61 and 75 has a downward protruding member 49, 63 and 77 respectively designed to be inserted into corresponding upper ends 52 and 66 of the piling segment means and the top end 44 of the piling starter segment means 11. Each piling segment means 47, 61 and 75 is added one after the other and positioned on top of the piling starter segment means 11 to further drive the piling starter segment means 11 into the ground.

Operatively speaking, the downward protruding member 49, preferably cylindrically shaped, of one of the piling segment means 47 (hereinafter called a "first piling segment means") is inserted into the top end 44 of the piling starter segment means 41. An adhesive or sealing means, preferably epoxy glue, is added to connect each piling segment means 47, 61 and 75 one to the other. The epoxy adhesive and seal is preferred because it not only acts as sealant, but it also effectively adheres the piling segment means 47, 61, and 75 together so that the apparatus as a whole will resist bending and buckling and increase its stability. As the first piling segment means 47 is driven into the ground, preferably by a hydraulic ram, an additional piling segment 61 (hereinafter called a "second piling segment means") is inserted into the ground and is placed on top of and attached to the first segment means 47.

The downward protruding member 63 of the second piling segment means 61, preferably cylindrically shaped, is inserted into an upper cylindrical member 52 of the first piling segment means 47 and the adhesive is used to help create a seal. When a subsequent piling segment means 75 (hereinafter called a "third piling segment means") 75 is connected to the second piling segment means 61, its downward protruding member 77, preferably cylindrically shaped, of the third piling segment means 75 is inserted into an upper cylindrical member 66 of the second piling segment means 61 and the adhesive is used to help fasten the connection. The three piling segment means 47, 61 and 75 are each designed in the same manner to enhance compatibility and provide uniform to the overall configuration of the pier 10. The use of three piling segments 47, 61 and 75 has been described but it is understood that more or less piling segments could be used in accordance with this invention depending on the conditions of the ground below the foundation 122 and the distance that the piling segments will need to be driven into the ground to support the foundation 122.

The crown means 89 is positioned on the upper end 80 of the final piling segment means (shown in FIG. 1 as 75) to provide increased contact surface area. The crown means is typically added at the upper section after the driving device is used to drive a sufficient number of segments into the ground to support the foundation and lift it to the desired position.

The first piling segment means 47 is inserted into the ground and is positioned on the piling starter segment means 11. The ram or jack is placed on top of the upper segment to drive it into the ground. The crown means 89 may be placed on the upper end 52 of the first piling segment means 47 to provide increased stability. The driving device is placed on the upper end of the upper segment means to cause the first piling segment means 47 to be pushed in a downward fashion, thereby driving the piling starter segment means 11 further into the ground. After each piling segment means, such as the second and third piling segment means 61 and 75, is inserted into the hole and stacked on each other, the ram or jack means is be placed on the upper end 66 and 80 of the piling segments to allow a driving device to be positioned thereon in a safe manner.

Throughout this insertion process of the piling starter segment means 11 and the first, second and third piling segment means 47, 61 and 75 into the ground, the reaction force (pressure) acting from the ground against the driving device should be monitored. Each piling segment means 47, 61, and 75 is continually added and connected to one another until a sufficient pressure is obtained, preferably about 6000–8000 psi. At this pressure, the reaction force from the piling segments means 47, 61, and 75, piling starter segment means 11 and the ground below is generally sufficient to provide a stable platform to raise the slab beam 124 and to sustain the weight of the structure above. Once the proper pressure is reached, no more piling segments 47, 61 and 75 are added.

The piling segment means 47, 61, and 75, and the piling starter segment means 11 are driven into the ground until the upper end 80 of the third segment means 75 rests underneath the slab beam 124. The crown means 89 is placed between the slab beam 124 and the upper end 80 of the third piling segment means 75. The crown means 89 includes a base member 95 having a collar 90 extending downwardly there from. The collar 90 is disposed about the third segment means 75 to form a connection between the crown means 89 and the third piling segment means 75. This connection is specifically formed by way of the upper cylindrical member 76 being inserted into the collar 90 until the upper end 80 of the third piling segment means 75 comes into contact with a bottom edge 120 of a base support member 116 of the crown means 89. In a preferred embodiment, the upper end 80 of the third piling segment means 75 and the bottom edge 120 of the base support member 116 each have a circular edge.

The crown means 89 is positioned to facilitate placing the lifting device 125 into a gap formed between support members 106 and 111. Each support member 106 and 111 is positioned parallel to one another and extends upwardly from a top exterior surface 97, whereby the plane created by the cylindrical support members 106 and 111 should face the opening of the excavated hole. The support members 106 and 111 are identically configured, preferably having a cylindrical shape, to provide uniformity, balance and stability. Collectively, the piling starter segment means 11, the piling segment means 47, 61, and 75, and the crown means 89 collectively form the pier 10 upon which the lifting device 125 may be set to raise the slab beam 124.

The lifting device 125 is placed on the crown means 89 between the support members 106 and 111 such that the vector of its power stroke is aligned with the cylindrical base support member 116 within a base member 95 and the vertical axis of the piling starter segment 11 and the piling segment means 47, 61, and 75. The lifting device 125 is then used to raise slab beam 124 to the appropriate level and shim(s) 126 are placed atop the support members 106 and 111 until the shim(s) 126 fill the gap created by raising the slab beam 124. The cylindrical base support member 116 located inside the base member 95 maximizes the lift strength of the lifting device 125 once it is placed on the crown means 89 because it directly transfers the reactive force from piling segments means 47, 61, and 75 and piling starter segment 11 to the slab beam 124. Otherwise, the reactive force acting through tubing, preferably having a square configuration, of the base member 95 alone would be dissipated to some degree by the bending moments created by the flexing in a top exterior surface 97, a top interior surface 101, a bottom exterior surface 99, and a bottom interior surface 103. In a preferred embodiment, each exterior surface 97 and 99 and interior surface 101 and 103 has a rectangular shape. In the event that an adjustment of the height of the slab beam 124 is needed, the lifting device 125 would be inserted into a re-excavated hole and is capable of raising or lowering the slab 124 to a newly desired level.

Figure 2A:
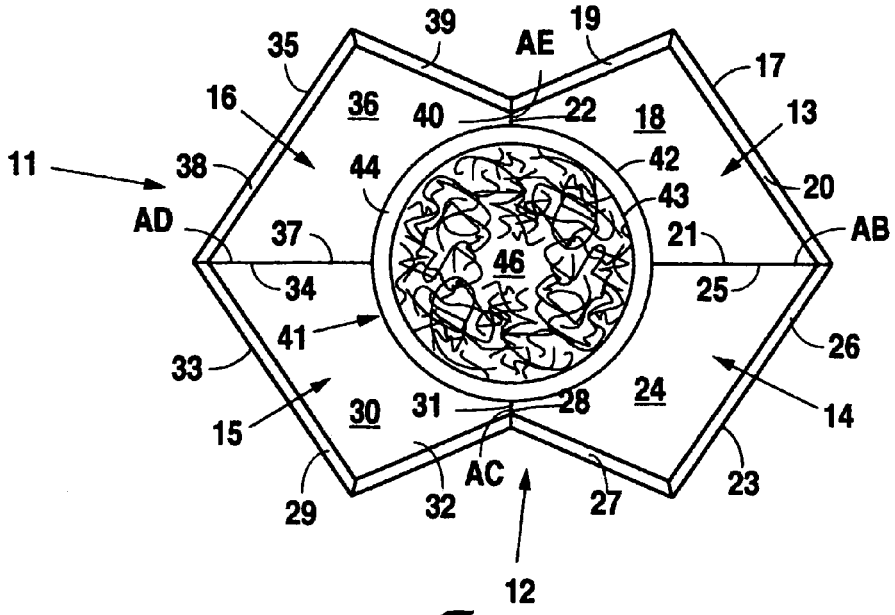
FIG. 2*a* shows a top view of a piling starter segment.
Figure 2B:
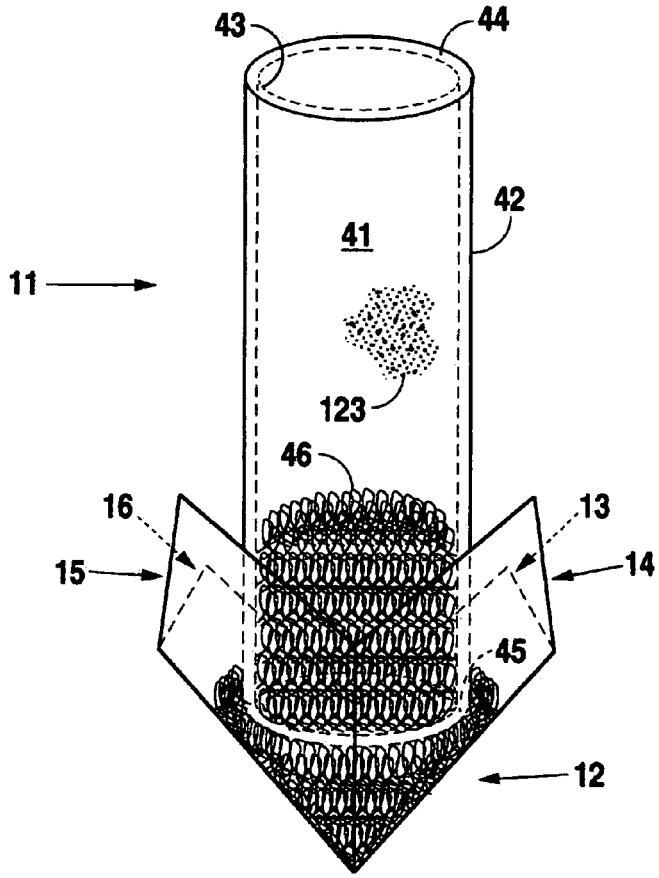
FIG. 2*b* shows a front view of the piling starter segment.

FIGS. 2*a* and 2*b*, show the details of the piling starter segment means 11. The piling starter segment means 11 is composed of a tip member 12 coupled to a starter segment member 41. Preferably, the tip member 12 has a point and is composed of multiple trapezoidal shaped members 13, 14, 15, and 16 that are joined together to make a pyramid shape. As shown in FIG. 2*a*, one of the trapezoidal members (hereinafter called the "first trapezoid member 13") is composed of an outer trapezoid surface 17, an inner trapezoid surface 18, and multiple rectangular connector edges 19, 20, 21, and 22 that connect the outer trapezoid surface 17 and the inner trapezoid surface 18 together. A first connector edge 19 is located at the top edge of the first trapezoid member 13. A second connector edge 20 extends perpendicularly from the first connector edge 19 and intersects perpendicularly with a third connector edge 21. The first and third connector edges 19 and 21 are located opposite from each other and extend parallel to one another, with the first connector edge 19 being shorter in length than the third connector edge 21. Finally, a fourth connector edge 22 is the opposite edge of the second connector edge 20 and runs diagonally between the first and third connector edges 19 and 21. The first trapezoid member 13 is connected to a second trapezoid member 14 along reference line AB. Reference line AB is the intersection between the third connector edge 21 of the first trapezoid member 13 and a first connector edge 25 of the second trapezoid member 14.

The second trapezoid member 14 is composed of an outer trapezoid surface 23, an inner trapezoid surface 24, and multiple rectangular connector edges 25, 26, 27, and 28 that connect the outer trapezoid surface 23 to the inner trapezoid surface 24. The first connector edge 25 is located substantially parallel to a third connector edge 27, where the third connector edge is located at a top edge of the second trapezoid member 14. A second connector edge 26 and a fourth connector edge 28 are positioned opposite each other. The second connector edge 26 extends substantially perpendicularly from the third connector edge 27 and intersects substantially perpendicularly with the first connector edge 25. The first and third connector edges 25 and 27 are opposite edges of the second trapezoid member 14 and extend parallel to one another, with the third connector edge 27 being shorter in length than the first connector edge 25. Finally, the fourth connector edge 28 is the opposite edge of the second connector edge 26 and runs diagonally between the first and third connector edges 25 and 27. The second trapezoid member 14 is connected to a third trapezoid member 15 along reference line AC. Reference line AC is the intersection between the fourth connector edge 28 of the second trapezoid member 14 and a first connector edge 31 of the third trapezoid member 15.

The third trapezoid member 15 is composed of an outer trapezoid surface 29, an inner trapezoid surface 30, and a plurality of rectangular connector edges 31, 32, 33, and 34 that connect the outer trapezoid surface 29 to the inner trapezoid surface 30. A second connector edge 32 is a top edge of the third trapezoid member 15 and is positioned substantially parallel to a fourth connector edge 34. A third connector edge 33 extends substantially perpendicularly from the second connector edge 32 and intersects substantially perpendicularly with the fourth connector edge 34. The second and fourth connector edges 32 and 34 are opposite edges of the third trapezoid member 15 and extend parallel to one another, with the second connector edge 32 being shorter in length than the fourth connector edge 34. Finally, the first connector edge 31 is the opposite edge of the third connector edge 33 and runs diagonally between the second and fourth connector edges 32 and 34. The third trapezoid member 15 is connected to a fourth trapezoid member 16 along reference line AD. Reference line AD is the intersection between the fourth connector edge 34 of the third trapezoid member 15 and a first connector edge 37 of the fourth trapezoid member 16. The fourth trapezoid member 16 is composed of an outer trapezoid surface 35, an inner trapezoid surface 36, and multiple rectangular connector edges 37, 38, 39, and 40 that connect the outer trapezoid surface 35 to the inner trapezoid surface 36. A third connector edge 39 is the top edge of the fourth trapezoid member 16 and is substantially parallel to the first connector edge 37. A second connector edge 38 extends substantially perpendicular from the connector edge 39 and intersects substantially perpendicularly with the first connector edge 37. The first and third connector edges 37 and 39 are opposite edges of the fourth trapezoid member 16 and extend parallel to one another, with the third connector edge 39 being shorter in length than the first connector edge 37. Finally, a fourth connector edge 40 is the opposite edge of the second connector edge 38 and runs diagonally between the first and third connector edges 37 and 39. The fourth trapezoid member 16 is connected to the first trapezoid member 13 along reference line AE. Reference line AE is the intersection between the fourth connector edge 40 of the fourth trapezoid member 16 and the connector edge 22 of the first trapezoid member 13.

The third connector edge 21 of the first trapezoid member 13 and the first connector edge 25 of the second trapezoid member 14 are identical to the first connector edge 37 of the fourth trapezoid member 16 and the fourth connector edge 34 of the third trapezoid member. The fourth connector edge 28 of the second trapezoid member 14 and the first connector edge 31 of third trapezoid member 15 are identical to the fourth connector edge 22 of the first trapezoid member 13 and the fourth connector edge 40 of the fourth trapezoid member 16. The trapezoid members 13, 14, 15, and 16 each form a 45° angle from the central axis which extends through the center of the tip member 12 of the starter segment means 41.

In FIG. 2*b*, the tip member 12, preferably made of angle iron, has a point which serves to ease insertion into the ground and prevents bending and denting to the starter segment means since the tip member 12 encounters obstructions, e.g. rocks and tree roots, on its way down. Once the tip member 12 is positioned, it acts as an anchor to prevent upheaval of the formed pier 10 due to soil expansion and/or contraction. Inside trapezoid surfaces 18, 24, 30, and 36 of the tip member 12 shown in FIG. 2*a* are welded to a bottom edge 45 shown in FIG. 2*b* of the starter segment member 41 to form the piling starter segment means 11. The starter segment member 41 is centrally positioned on the tip member 12 and is fastened, preferably welded, into place. The starter segment member 41 extends substantially vertically from the points of contact between the bottom edge 45 of the starter segment member 41 and the inside trapezoid surfaces 18, 24, 30, and 36 of the tip member 12.

The tip member 12 may be constructed by welding the tip member 12 to the starter segment member 41. The starter segment member 41 may be injected with an insulating substance to seal any gaps therein or at the welding point. Then the tip member 12 and the starter segment member 41 may both be coated with a substance, preferably asphalt.

The starter segment member 41 is composed of an outer surface 42, an inner surface 43, a top edge 44, and the bottom edge 45. Preferably, the outer surface 42 and inner surface 43 are shaped in a cylindrical fashion and the top 44 and bottom 45 edges have a circular shape. The outer surface 42 and the inner surface 43 are shaped to create a tight fit between the starter segment pipe member 41 and the piling segment means 11. After the tip member 12 and the starter segment pipe member 41 are fastened together, preferably through welding, the bottom portion of the starter segment pipe member 41 is filled with an insulating material 46, including but not limited to a foamy substance to seal off gaps in the piling starter segment means 11, namely between the tip member 12 and the starter segment pipe member 41. The piling starter segment means 11 is then coated with an asphalt coating 123 to provide insulation of piling starter segment means 11. The insulation provided by the asphalt coating 123 prevents corrosion of the piling starter segment means 11 by preventing water and dirt from reacting with the outside surface of the piling starter segment means 11. Further the asphalt coating 123 prevents water and dirt from entering the piling starter segment means 11 and corroding it from its interior. Prevention of corrosion is essential for the piling starter segment means 11 to resist the shear and compressive forces from the foundation 122.

Figure 3:
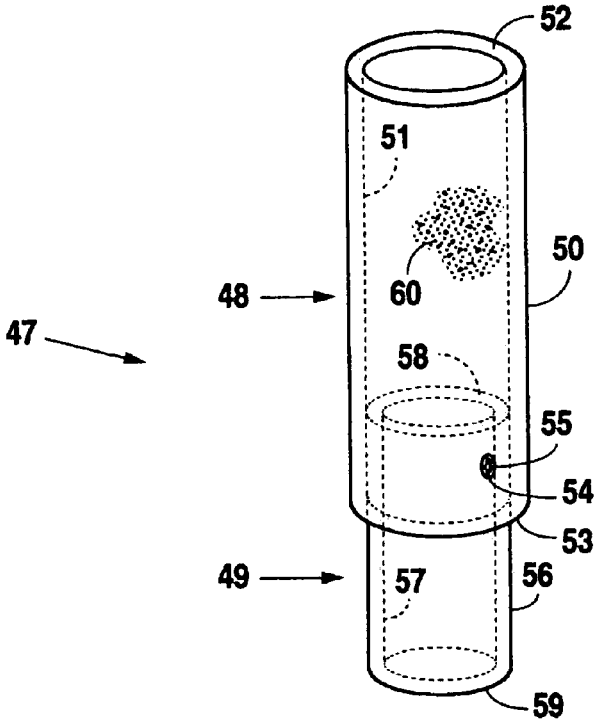
FIG. 3 shows a front view of an additional piling segment.

In FIG. 3, the first piling segment means 47 is composed of an upper member 48 and a lower member 49, where each member is preferably cylindrically shaped. The first piling segment means 47 is formed when a portion of the lower member 49 is orthogonally inserted into the upper member 48. The upper member 48 of the first piling segment means 47 is composed of an outer cylindrical surface 50, an inner cylindrical surface 51, the upper circular end 52, and a bottom circular edge 53. The lower member 49 of the first piling segment means 47 also has an outer cylindrical surface 56, an inner cylindrical surface 57, a top circular edge 58 and a bottom circular edge 59.

The inside diameter of upper cylindrical member 48 is created by the inner cylindrical surface 51, and the outside diameter of the lower cylindrical member 49 is created by the outer cylindrical surface 56. When the lower cylindrical member 49 is telescopically inserted into the inside of the upper cylindrical member 48, a tight fit is formed between the upper member 48 and the lower member 49. Specifically, the lower cylindrical member 49 is inserted into the upper cylindrical member 48 until a portion of the lower member 49 is inside upper member 48 and a portion of the lower member 49 extends from the bottom edge 53 of the upper member 48.

Before the lower member 49 is inserted into the upper member 48, a hole 54 is bored through the upper member 48 at a distance from the bottom edge 53 that is less than the distance that the lower member 49 is inserted into the upper member 48. After the lower member 49 is inserted into the upper member 48, a weld spot 55 is made through the hole 54 to connect upper cylindrical member 48 to the lower cylindrical member 49. Although the use of only one hole 54 and one weld spot 55 is described for the first piling segment means 47, it is understood that there could also be additional holes and weld spots used to help strengthen the attachment of the upper member 48 to the lower member 49. After the upper and lower members 48 and 49 are attached together, the first piling segment means 47 is coated with asphalt coating 60 to provide insulation to the first piling segment means 47. The asphalt coating 60 provides insulation and protection to the first piling segment means 47 in the same manner as the asphalt coating 123 does to the piling starter segment means 11.

Figure 4:
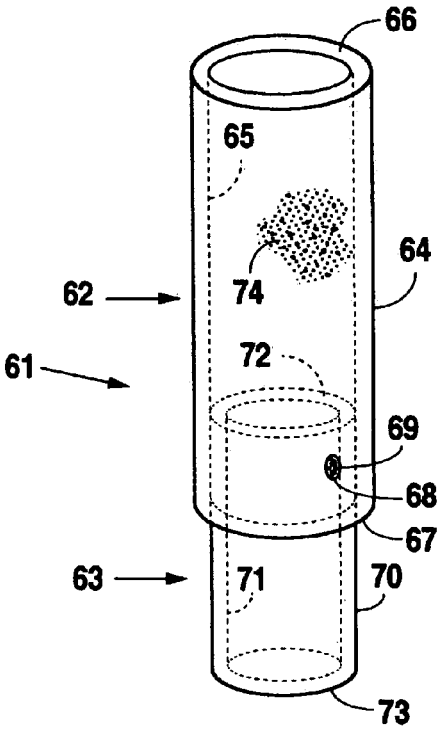
FIG. 4 shows a front view of another additional piling segment.

Seen in FIG. 4, the second piling segment means 61 is composed of an upper cylindrical member 62 and a lower cylindrical member 63. The second piling segment means 61 is formed when a portion of the lower member 63 is inserted into the upper member 62. The upper member 62 of the second piling segment means 61 is made up of an outer cylindrical surface 64, an inner cylindrical surface 65, a top circular edge 66 and a bottom circular edge 67. The lower member 63 of the second piling segment means 61 has an outer cylindrical surface 70, an inner cylindrical surface 71, a top circular edge 72 and a bottom circular edge 73. The inner cylindrical surface 65 of the upper cylindrical member 62 is sized so that there is a tight fit there between, especially when the lower member 63 is slipped inside of the upper member 62 to make the second piling segment means 61. The lower cylindrical member 63 is inserted into the upper cylindrical member 62 until a portion of the lower member 63 is inside the upper member 62 and a portion of the lower member 63 extends from the bottom edge 67 of the upper member 62.

Before the lower member 63 is inserted into the upper member 62, a hole 68 is drilled through both the outer cylindrical surface 64 and the inner cylindrical surface 65 of the upper member 62. The hole 68 is drilled at a distance from the bottom edge 67 which is less than the distance of the lower member 63 is inserted into the upper member 62. After the lower member 49 is inserted into the upper member 48, a weld spot 69 is located at the second piling segment means 61 through hole 68 and is used to connect the upper member 62 to the lower member 63. Although the use of only one hole and weld spot is described for second piling segment means 61 it is understood that there could also be additional holes and weld spots used to help strengthen the attachment of upper cylindrical member 62 to the lower cylindrical member 63. After the upper member 62 and the lower member 63 are attached together, the second piling segment means 61 is coated with asphalt coating 74 to provide insulation to the second piling segment means 61. The asphalt coating 74 provides insulation and protection to the second piling segment means 61 in the same manner as the asphalt coating 60 does to the first piling segment means 47.

Figure 5:
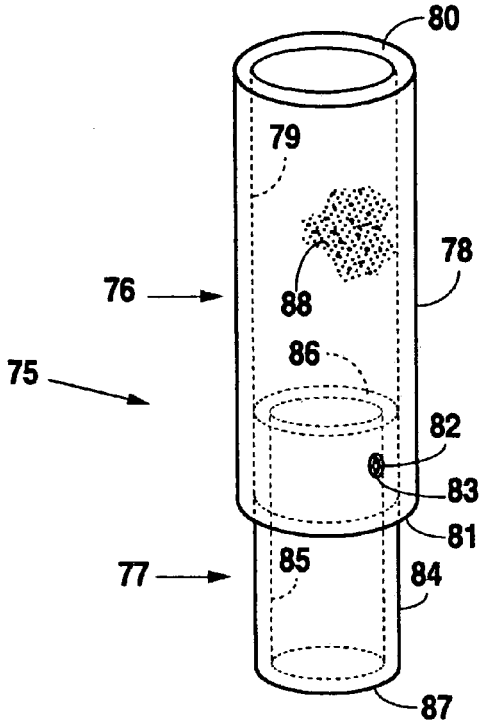
FIG. 5 shows a front view of a further additional piling segment.

Seen in FIG. 5, the third piling segment means 75 is composed of an upper cylindrical member 76 and a lower cylindrical member 77. The third piling segment means 75 is formed when a portion of the lower member 77 is inserted into the upper member 76. The upper member 76 of the third piling segment means 75 has an outer cylindrical surface 78, an inner cylindrical surface 79, a top circular edge 80 and a bottom circular edge 81. The lower member 77 of the third piling segment means 75 has an outer cylindrical surface 84, an inner cylindrical surface 85, a top circular edge 86 and a bottom circular edge 87. The inner surface 79 of the upper member 76 and the outer surface 84 of the lower member 77 form a tight fit together when the lower member 77 is slipped inside of the upper member 76. The lower member 77 is inserted into the upper member 76 until a portion of the lower member 77 is inside the upper member 76 and a portion of the lower member 77 extends out from the bottom edge 81 of the upper member 76.

Before the lower member 77 is inserted into the upper member 76, a hole 82 is drilled through the upper cylindrical member 76. The hole 82 is drilled through the outer surface 78 and the inner surface 79 at a distance from the bottom edge 81 which is less than the distance that the lower member 77 is inserted into the upper member 78. After the lower member 77 is inserted into the upper member 76, a weld spot 83 is made at the third piling through the hole 82 and is used to connect the upper member 76 to the lower member 77. Although the use of only one hole 82 and one weld spot 83 is described for the third piling segment means 75, it is understood that there could also be additional holes and weld spots used to help strengthen the attachment of the upper member 76 to the lower member 77. After the upper and lower members 76 and 77 are attached together, the third piling segment means 75 is coated with asphalt coating 88 to provide insulation to the third piling segment means 75. The asphalt coating 88 provides insulation and protection to the third piling segment means 75 in the same manner as asphalt coating 74 does to the second piling segment means 61.

Figure 6A:
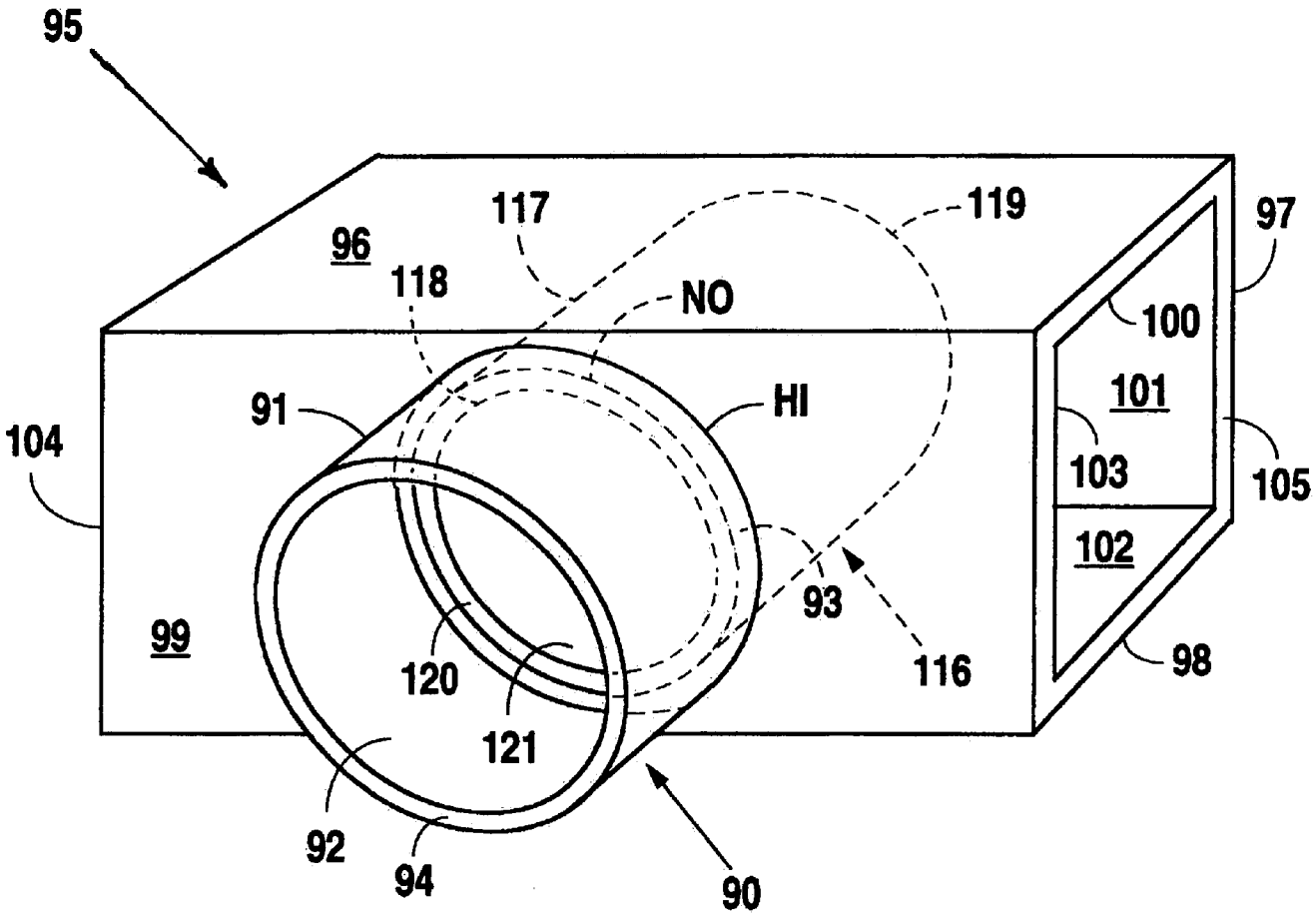
FIG. 6*a* shows perspective view of a base member and collar of a crown.

In FIG. 6*a*, the cylindrical collar 90 has an outside cylindrical surface 91, an inside cylindrical surface 92, a top circular edge 93, and a bottom circular edge 94. The cylindrical collar 90 is centered and welded onto a bottom surface 99 of the base member 95 along reference circle line HI. The cylindrical collar 90 concentrically surrounds a hole 121 which is bored through the center of the bottom surface 99 and a bottom interior surface 103.

The cylindrical base support member 116 has an outside cylindrical surface 117, an inside cylindrical surface 118, a top circular surface 119, and a bottom circular surface 120. After the hole 121 is drilled, the cylindrical base support member 116 is inserted into the base member 95 until the top circular edge 119 is in contact with the top inside rectangular surface 101 of the base member 95. The bottom circular edge 120 of cylindrical base support member 116 is flush with the bottom outside rectangular surface 99 and then the cylindrical base support member 116 and the bottom outside rectangular surface 99 are welded together along reference circle NO.

Figure 6B:
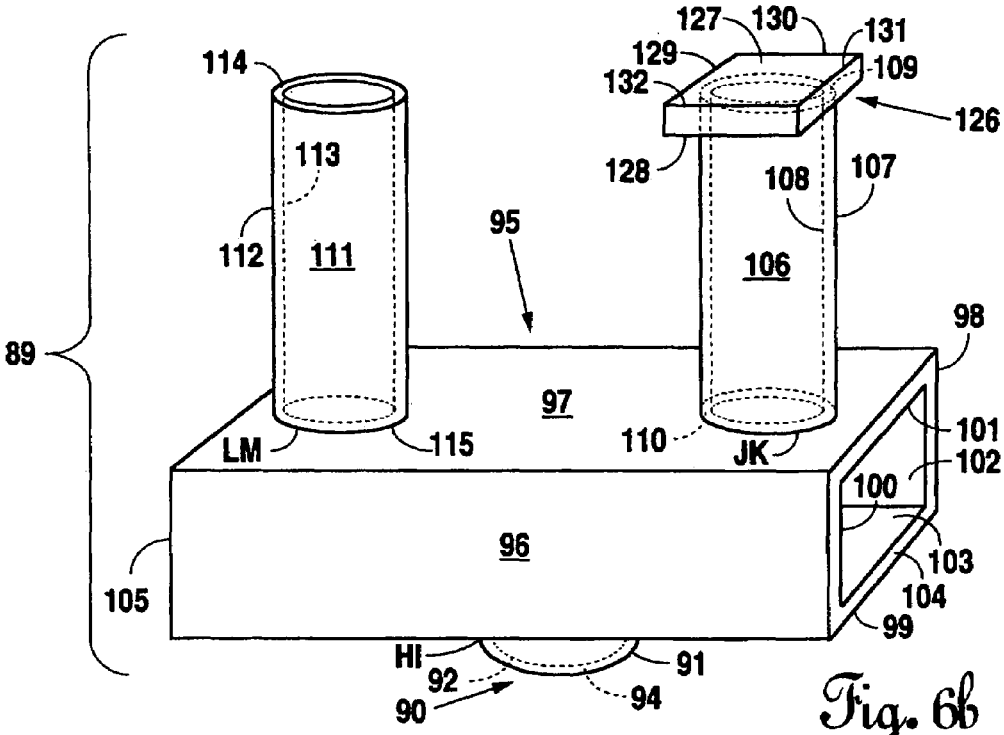
FIG. 6*b* is a perspective view of the crown in its entirety.

In FIGS. 6*a* and 6*b*, the base member 95 of the crown means 89 has a tube, preferably square-shaped and desirably welded onto the crown means, with outside surfaces that include: a front exterior surface 96, a top exterior surface 97, a back exterior surface 98, and a bottom exterior surface 99, where each surface is preferably rectangularly shaped. The inside surface of the base member 95 comprises of a front interior surface 100, a top interior surface 101, a back interior surface 102 and a bottom interior surface 103, where each surface is preferably rectangularly shaped. A right square edge 104 and a left square edge 105 connect all of the exterior and interior surfaces of the base member 95 together. After the hole 121 is cut in the base member 95, the cylindrical base support member 116 is inserted into the base member 95.

FIG. 6*b* shows the first and the second support members 106 and 111 being attached to the base member 95, preferably by being welded upright, at opposite ends of the top exterior surface 97. The first support member 106 has an outside cylindrical surface 107, an inside cylindrical surface 108, a top circular edge 109, and a bottom circular edge 110. The first cylindrical support member 106 is welded on an end of the top exterior surface 97 along reference circle JK. Reference circle JK is where the bottom edge 110 of the first support member 106 and the top exterior surface 97 intersect. The cylindrical support member 111 has an outside cylindrical surface 112, an inside cylindrical surface 113, a top circular edge 114, and a bottom circular edge 115. The cylindrical support member 111 is welded on an end of top exterior surface 97 along reference circle LM. Reference circle LM is where the bottom edge 115 of the second support member 111 and the top exterior surface 97 intersect. The first and the second support members 106 and 111 should be spaced apart such that the center of each support member 106 and 111 is the same distance from the center of top exterior surface 97 of the base member 95, and so that the lifting device 125 can fit between the first and the second support members 106 and 111. Also, the first and the second support members 106 and 111 should be centered about the width of top exterior surface 97.

The shims 126 shown in FIG. 6*b* are preferably thin, square sections of metal that are used to fill the gap between the slab beam 124 of the foundation 122 and the first and the second support member 106 and 111. The shims 126 are composed of a top surface 127, a bottom surface 128, and multiple edges 129, 130, 131, and 132. Once the shims 126 are placed in position, the lifting device 125 is lowered and removed from the crown means 89 so that all the weight of the foundation 122 is now resting on the formed pier 10. The lifting device 125 is then removed and the excavated hole is refilled.

Figure 6C:
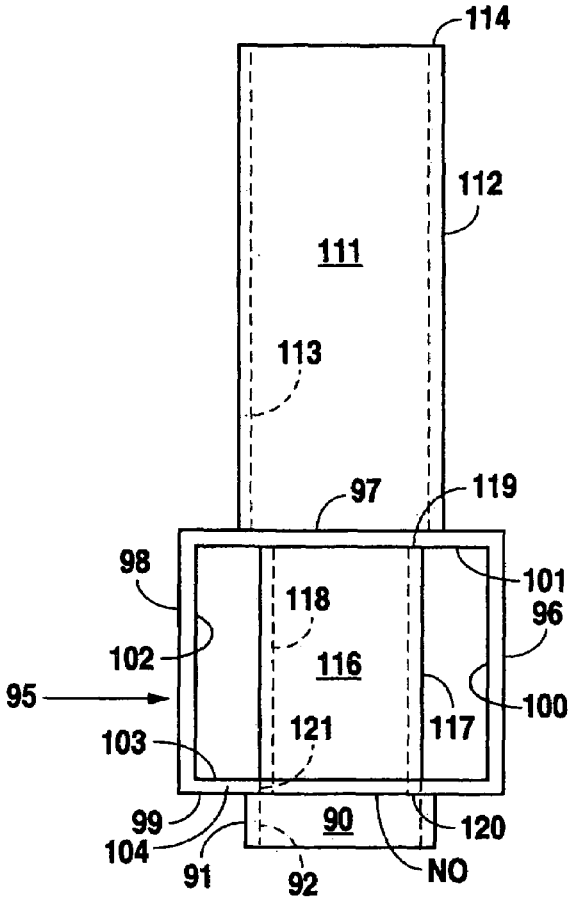
FIG. 6*c* shows a side view of the crown.

FIG. 6*c* shows the crown means 89 being used to stabilize and distribute the weight of the foundation 122 over a greater area, which is done by utilizing the first and the second support members 106 and 111. Also, the crown means 89 facilitates easy access to the slab beam 124 in the event the slab beam 124 needs to be raised or lowered, where anyone, even a person with no expertise, can use the lifting device 125 to manipulate the formed pier 10.

While the above detailed description describes a preferred embodiment and best mode of the invention, it should be understood and apparent to those skilled in the art that various other embodiments of the invention can be created without departing from the spirit and scope of the invention, which is defined in the claims that follow.

The invention claimed is:

1. An apparatus for leveling a building and its existing foundation by utilizing a pier comprising:

a piling starter segment means having a steel starter segment member having a top end and a tip member being opposingly positioned from said top end, said tip member having a point capable of drilling into the earth, thereby making room for interconnected piling segments to be inserted;

a plurality of steel interconnected piling segments having an upper end and a bottom end having a protruding member extending downwardly from said bottom end, wherein said interconnected segments are stacked one on top of another, said protruding member of a first inserted interconnected segment is inserted into said top end of said piling starter segment means forming a first joint and said protruding member of a second inserted interconnected segment is inserted into said upper member of said first inserted interconnected segment to form a second joint;

an adhesive and sealant applied between each of said joints to seal said joints and to adhere said piling starter segment means to said first inserted interconnected segment and adhere said first inserted interconnected segment to said second segment;

a steel crown means having a base member support inset with support members extending from said base member support inset in an upward fashion and a base member having a collar positioned on and extending downwardly from said base member, wherein said crown means is placed at said upper end of said interconnected piling segment and said foundation allowing for a lifting device to drive said piling starter segment means and said interconnected segments into said earth to level said foundation; and at least one shim placed on top of said support members of said crown means.

2. The apparatus as recited in claim 1, wherein said protruding member of a subsequent interconnected segment is inserted into said upper member of said second interconnected segment.

3. The apparatus as recited in claim 1, wherein said adhesive is an epoxy adhesive.

4. The apparatus as recited in claim 1, wherein said interconnected piling segments are added onto one another until a sufficient pressure is reached to support said foundation.

5. The apparatus as recited in claim 1, wherein said pressure to support said foundation is in the order of 6000 psi.

6. The apparatus as recited in claim 1, wherein said pressure to support said foundation is in the order of 8000 psi.

7. The apparatus as recited in claim 1, wherein said tip member has a point comprising of multiple trapezoidal shaped members being connected to one another, wherein each of said trapezoidal members has an outer surface, an inner surface and multiple connector edges, where said connector edges join said outer surface to said inner surface.

8. The apparatus as recited in claim 1, wherein said tip member is made of angled iron.

9. The apparatus as recited in claim 1, further comprising a sealing material being injected into said piling starter segment means to seal off gaps located therein.

10. The apparatus as recited in claim 1, further comprising an asphalt coating to coat said piling starter segment means.

11. The apparatus as recited in claim 1, wherein said upper member of said piling segment means and said lower member of said piling segment means both have an outer surface, an inner surface, an upper end and a bottom edge, and further comprising a hole bored through said upper member of said piling segment means at a distance from said bottom edge that is less than a distance that said lower member is inserted into said upper member.

12. The apparatus as recited in claim 11, further comprising a weld spot made through said hole, thereby connecting said upper member to said lower member.

13. The apparatus are recited in claim 1, wherein said pier segments allow for positioning and connecting through a tunnel under an interior beam of a slab without drilling an access hole in the interior of the slab.

14. The apparatus as recited in claim 13, wherein said collar is centered on said base member and covers said hole.

15. A method of lifting foundation from beneath an existing building comprising the steps of:

excavating a hole underneath a slab beam of said foundation;

placing a starter segment means into said hole and driving said starter segment means beneath said slab beam;

inserting interconnected piling segments onto said starter segment means;

driving said piling segments into said hole with a jack means;

fastening said piling segments to each other and to said starter segment means;

placing a crown means on the upper portion of the upper segment and lifting said slab beam to a desired level height;

placing shims between said crown means and said slab beam.

16. The method of lifting foundation as recited in claim 15, further comprising injecting a substance into said starter segment means to prevent corrosion.

17. The method of lifting foundation as recited in claim 15, further comprising coating said interconnected piling segments with asphalt.

18. The method of lifting foundation as recited in claim 15, further comprising coating said starter segment means with asphalt.

19. The method of lifting foundation as recited in claim 15, further comprising a method to construct said interconnected piling segment comprising the steps of:

forming a hole into an upper member of said piling segment, wherein said upper member having a top end and a lower end; and inserting a lower member into said lower end of said upper member, where said lower member having a diameter smaller than said upper member.

20. The method as recited in claim 19, further comprising the step of welding said upper member to said lower member.

21. The method as recited in claim 19, further comprising a method to lock each of said interconnected piling segments, this method comprising the steps of:

coating said lower member of said piling segments; and sliding said lower member into said lower end of said upper member.

22. The method as recited in claim 15, further comprising a method to construct said starter segment means, the method comprising the steps of:

welding a tip member to a starter segment member;

coating said tip member and said starter segment member with a substance; and filling said starter segment means with a sealing substance to seal any gaps at welding point.

23. The method as recited in claim 15, wherein a tunnel is dug under the slab and the pier is positioned through the tunnel to support an interior beam of the slab.

24. The method as recited in claim 15, further comprising a method for constructing said crown means comprising the steps of:

forming a hole into a base member of said crown means and attaching a collar onto said hole; and welding support members onto said crown means.

25. The method as recited in claim 15, wherein said lifting device is re-inserted into a re-excavated hole to readjust said slab to re-level said foundation.

26. An apparatus for leveling a building and its existing foundation by utilizing a pier comprising:

a piling starter segment means having a steel starter segment member having a top end and a tip member being opposingly positioned from said top end, said tip member having a point capable of drilling into the earth, thereby making room for interconnected piling segments to be inserted, and flanges capable of resisting upheaval due to soil expansion;

a plurality of steel interconnected piling segments having an upper end and a bottom end having a protruding member extending downwardly from said bottom end, wherein said interconnected segments are stacked one on top of another, said protruding member of a first inserted interconnected segment is inserted into said top end of said piling starter segment means forming a first joint and said protruding member of a second inserted interconnected segment is inserted into said upper member of said first inserted interconnected segment to form a second joint;

an adhesive and sealant applied between each of said joints to seal said joints and to adhere said piling starter segment means to said first inserted interconnected segment and adhere said first inserted interconnected segment to said second segment;

a steel crown means having a base member support inset with support members extending from said base member support inset in an upward fashion and a base member having a collar positioned on and extending downwardly from said base member, wherein said crown means is placed at said upper end of said interconnected piling segment and said foundation allowing for a lifting device to drive said piling starter segment means and said interconnected segments into said earth to level said foundation; and at least one shim placed on top of said support members of said crown means.

* * * * *